United States Patent [19]

Due

[11] 4,456,303

[45] Jun. 26, 1984

[54] MACHINE AND METHOD FOR GROOVING PAVEMENT

[76] Inventor: Joseph E. Due, 777 Crescent, P.O. Box 134, Mauston, Wis.

[21] Appl. No.: 365,777

[22] Filed: Apr. 5, 1982

[51] Int. Cl.[3] ..... E01C 23/09

[52] U.S. Cl. ..... 299/10; 125/14; 51/327; 299/39; 299/89

[58] Field of Search ..... 299/10, 39, 89; 404/87, 404/93, 74, 107; 125/14, 15; 51/327

[56] References Cited

U.S. PATENT DOCUMENTS

| | | | |
|---|---|---|---|
| 805,685 | 11/1905 | Swanson | 299/89 |
| 828,734 | 8/1906 | Gammie | 299/39 X |
| 1,411,864 | 4/1922 | Mitrovich | 299/39 |
| 1,553,845 | 9/1925 | Bardol | 299/39 |
| 1,964,746 | 7/1934 | Sloan | 299/39 |
| 2,934,327 | 4/1960 | Lewis | 299/39 |
| 2,984,471 | 5/1961 | Jackson | 299/10 |
| 3,001,778 | 9/1961 | Tomita | 299/39 |
| 3,020,812 | 2/1962 | Gross | 404/107 |
| 3,156,231 | 11/1964 | Harding | 299/39 |
| 3,747,981 | 7/1973 | Zuzezo | 299/10 X |
| 4,062,594 | 12/1977 | Haspert | 299/10 |

*Primary Examiner*—Ernest R. Purser

[57] ABSTRACT

A method and apparatus are disclosed for grinding out a crack in pavement in preparation for filling the crack. A narrow groove is formed in the pavement following the crack by a single grooving blade having a first thickness. The single grooving blade is replaced with a second grooving blade assembly having a thickness greater than the single grooving blade, and the second grooving blade assembly is moved along the groove and with the second grooving blade assembly engaging opposite edges of the groove and for forming upwardly outwardly sloping sidewalls.

9 Claims, 5 Drawing Figures

MACHINE AND METHOD FOR GROOVING PAVEMENT

FIELD OF THE INVENTION

The invention relates to machinery for grinding or cutting a groove in pavement or similar surfaces of concrete, asphalt or other paving materials.

BACKGROUND PRIOR ART

Pavements such as roads, airport runways, and parking lots commonly develop cracks by reason of temperature induced expansion or contraction. Such cracks are worsened if moisture is permitted to enter the cracks and if freezing and thawing occurs. It is desirable to grind or saw a groove in the pavement along these cracks to provide an expansion and contraction joint and to then fill the groove with an appropriate resilient and weather resistant sealant to preclude water or moisture from entering the groove.

An example of a prior art pavement grooving machine is illustrated in the U.S. Zuzelo Pat. No. 3,747,981, issued July 24, 1973. Such machines have the deficiency of being difficult for the operator to guide along a non-linear crack. Additionally, the grooving blade or grinding discs available for use in grooving pavement are subject to relatively rapid wear and must be replaced frequently. In machines such as that shown in the Zuzelo patent, where the grooving blades are mounted centrally in the machine, access to the blades is difficult and substitution of blades can be labor intensive and time consuming.

Other prior art machines for use in working a crack in pavement have included a relatively small frame supported on casters and with the frame supporting an engine. The engine is mounted on a rearward portion of the frame and the casters are positioned beneath that portion of the frame to support the weight of the engine. A grinding wheel or saw is supported by a forward portion of the frame and adjacent one side of the frame. That machine is pulled forwardly by the operator with the grinding wheel or saw blade following the crack to form a narrow groove having parallel sides.

In many applications it is desirable to bevel the sides of the grooves formed in the pavement in order to facilitate the insertion of the resilient sealing material. Using the common prior art machines, once the grooving machine is used to form a groove, the beveled sides are formed by using manual or hand held grinding tools.

Attention is also directed to the U.S. Hisao Tomita et al. Pat. No. 3,001,778, issued Sept. 26, 1961; the U.S. Metzger Pat. No. 3,127,887, issued Apr. 7, 1964; the U.S. Regan Pat. No. 3,886,925, issued June 3, 1975; the U.S. Tatko Pat. No. 3,196,584, issued July 27, 1965; and the U.S. Benson et al. Pat. No. 4,267,814, issued May 19, 1981.

SUMMARY OF THE INVENTION

The invention provides an improved and simplified machine for use in forming a groove in pavement, either following a nonlinear crack or forming a linear groove to provide an expansion joint, the machine embodying the invention also comprising means for conveniently forming a beveled edge on the groove. The invention also includes a method for grinding a groove in pavement and for forming a beveled edge on that groove to thereby facilitate insertion of a resilient material into the groove.

More particularly, the invention includes a machine for use in forming a beveled edge on the sidewalls of a groove in pavement, the machine including roller means for supporting a frame for movement along the pavement surface, and a shaft rotatably supported by the frame for rotation about a horizontal axis transverse to the direction of movement of the frame, and a handle for guiding the frame as the frame moves across the pavement surface. The machine also includes an engine supported on the frame and drivingly connected to the shaft for rotatably driving the shaft, and a pair of grooving blades mounted on the shaft such that the grooving blades are positioned in stacked face-to-face relation and laterally of the frame, the grooving blades being positioned on the shaft with the faces of the grooving blades defining vertical planes parallel to the direction of movement of the frame.

The invention also includes a machine for use in grinding a groove in pavement, the machine including a flat generally horizontal plate, roller means for supporting the rearward portion of the plate for movement over the pavement, and a driven shaft supported beneath a forward portion of the plate and for rotation about a horizontal axis, one end of the shaft projecting from one lateral edge of the frame and the other end of the shaft projecting from an opposite lateral edge of the frame. Bearings are mounted on the lower surface of the plate and rotatably support the driven shaft. An engine is mounted on the upper surface of the plate and over the roller means, the engine including of rotatably driven output shaft. Means are also provided for drivingly connecting the output shaft to an end of the driven shaft, and a grooving blade is mounted on the other end of the shaft for rotation with the driven shaft, the grooving blade being supported laterally of the plate.

In one embodiment of the invention, the machine further includes a guiding handle assembly for guiding the plate, the guiding handle assembly including a first inclined support shaft having a lower end joined to the forward portion of the plate and extending upwardly and forwardly, a secondary inclined support shaft having a lower end joined to the forward portion of the plate and extending upwardly and laterally, and a handle extension having a lower end including a socket for alternatively housing one of the inclined support shafts.

In another preferred embodiment of the invention, the engine includes a flange adapted to be secured to the plate upper surface, bolts are provided for securing the flange to the upper surface, and means are also provided for limiting the tightening of the bolts, the limiting means including a bracket including a horizontal portion adapted to be clamped between a bolt and a flange and a second portion engageable with the plate.

In another preferred embodiment of the invention, the machine further includes means for selectively supporting the forward portion of the plate and the grooving blade off of the pavement.

The invention also includes a method for grinding out a crack in pavement in preparation for filling the crack, the method comprising the steps of grinding a narrow groove in the pavement following the crack, the groove having generally planar vertical sidewalls, the step of grinding including mounting a single grooving blade having a first thickness on an end of a horizontal rotatably driven shaft and causing the grooving blade to engage the pavement surface and to move along the crack. The method also includes the step of replacing the single grooving blade with a second grooving blade means having a thickness greater than the single grooving blade, and causing the grooving blade means to move along the groove and with the grooving blade means being supported for rotation about an axis perpendicular to the longitudinal direction of the groove and with opposite sides of the grooving blade means engaging opposite edges of the groove and for forming upwardly and outwardly sloping sidewalls.

One of the features of the invention is that it provides a simplified, low cost machine for forming a groove in pavement. Since the machine is relatively simple in construction, it can be relatively light weight and easily maneuvered such that the operator can guide the machine as he follows a non-linear crack in the pavement.

Another feature of the invention is that it provides a low cost and efficient means for sawing a groove in pavement and for subsequently forming beveled sidewalls on the groove.

Various other features and advantages of the invention will be apparent from the following description of a preferred embodiment, from the drawings, and from the claims.

Figure 1:
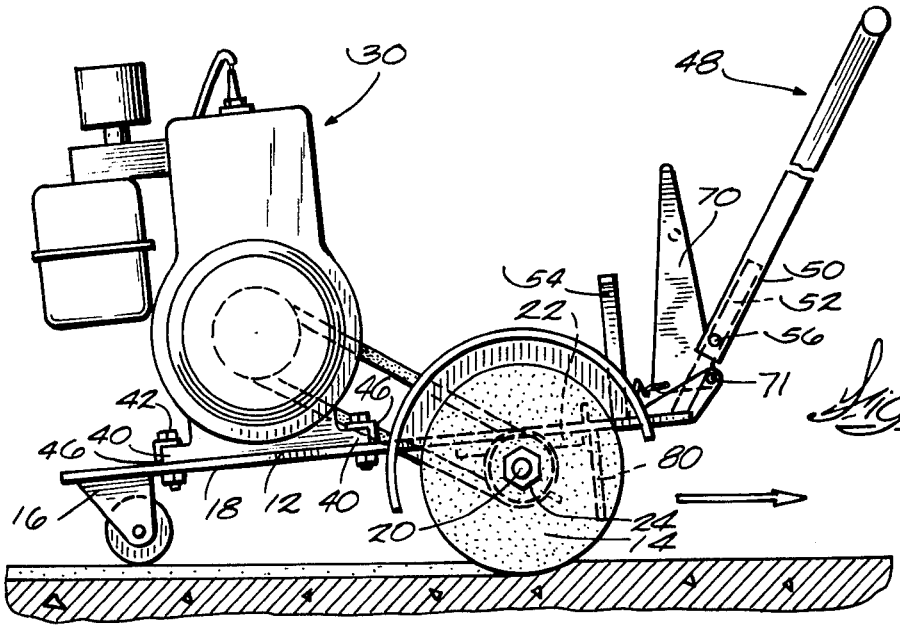
FIG. 1 is a side elevation view of a pavement grooving machine embodying the invention.

Before describing the preferred embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a saw or pavement grooving machine 10 embodying the present invention and adapted to form a groove in pavement or to score the pavement in connection with providing a means for forming an expansion joint in the pavement and in connection with sealing cracks in the pavement. While the machine 10 has other uses, in one preferred application of the machine, it can be used to follow a crack in concrete or other pavement to form a groove in the concrete and to subsequently bevel the side walls of the groove. A sealing material such as urethane can then be inserted into the groove to preclude moisture.

Referring more particularly to the machine 10 embodying the invention, it includes a frame adapted to be supported for movement over the pavement. While the frame could have other constructions, one of the features of the illustrated construction is that the frame is comprised of a single rigid flat metal plate 12.

Means are also provided for supporting the plate 12 for movement over the pavement and more particularly such that the plate 12 and a grooving blade 14 supported by the plate 12 are readily moved so that the machine can be accurately guided along a crack in the pavement. Since, in most cases, such a crack will be non-linear, it is important that the plate 12 be easily guided. In the illustrated arrangement, this maneuverability of the machine 10 is provided by a pair of casters 16 fixed directly to the lower surface 18 of a rearward edge of the rigid plate 12. The casters 16 are each freely rotatable about a vertical axis such that the machine 10 can be moved easily in any direction.

The grooving blade 14 is supported on one end of a driven shaft or mandrel 20, the mandrel 20 being mounted adjacent the lower surface 18 of the plate 12 and adjacent its forward end. More particularly, a pair of pillowblocks 22 are secured directly to the lower surface 18 of the plate adjacent the opposite lateral edges of the plate. The pillowblocks 22 include bearing surfaces for housing the opposite ends of the mandrel or driven shaft 20. The opposite ends of the shaft 20 also extend laterally outwardly from beneath the lateral edges of the plate, and the grooving blade is removably mounted on one of those ends. In the illustrated construction a nut 24 is threaded onto the end of the mandrel 20 and clamps the blade against a shoulder 26 of the mandrel.

Means are also provided for rotatably driving the driven shaft or mandrel 20. In the illustrated construction an internal combustion engine 30 is mounted directly on a rearward portion of the upper surface of the plate 12 and above the casters 16. In a preferred form of the invention, the engine 30 can be a five horsepower, 4-cycle engine. The engine 30 includes a drive shaft oriented in horizontal relation, the drive shaft having an end extending laterally of an edge of the plate 12 and supporting a pulley 34. A second pulley 36 is mounted on one end of the mandrel 20, and the pulleys 34 and 36 are drivingly connected by a drive belt 38. In a preferred form of the invention the drive ratio of the pulleys 34 and 36 is approximately one-to-one such that the mandrel 20 is rotated at approximately the same speed as the engine drive shaft.

Means are also provided for securing the engine 30 to the plate 12 in a manner which permits adjustment of the position of the engine 30 on the plate and so that the drive pulley 34 can be moved toward and away from the driven pulley 36 to thereby adjust the tension in the drive belt 38. The means for securing the engine 30 to the plate 12 also includes means for preventing the engine 30 from being damaged as it is clamped against the plate 12. As is conventional, the engine block includes flanges 40 adapted to rest on a mounting surface, and the flanges 40 house bolts 42. The plate 12 is provided with slots for receiving these bolts 42, these slots permitting movement of the engine 30 toward and away from the mandrel 20 to provide for adjustment of the tension in the belt 38.

In practice, if the bolts 42 are tightened severely, the flanges 40 and the engine block can be cracked. Means are provided in the illustrated arrangement for preventing such damage to the engine, such means including brackets 46. The brackets 46 are L-shaped in cross section and each include one leg adapted to be clamped between the head of a bolt 42 and the upper surfaces of the flange 40. The other leg extends downwardly to engage the upper surface of the plate 12 and prevents the bolt 42 from being tightened down too much against the flange 40.

A handle 48 is also provided for permitting the operator to guide the machine. In a preferred form of the invention the handle 48 is supported such that it can extend upwardly and forwardly for normal operation, and such that it can be moved to an alternative position when the forward portion of the machine approaches an obstruction such as a wall. More specifically, the handle 48 includes a lower end 50 comprising a socket which is adapted to slide onto an upwardly extending shaft 52. In a preferred form of the invention, the shaft 52 is supported by a central forward portion of the plate 12 and extends upwardly and forwardly. The shaft 52 is rectangular in cross section, and the socket 50 includes a bore also being rectangular in cross section such that the handle 48 can not rotate on the shaft 52. A second shaft 54 similar to shaft 52 is positioned adjacent shaft 52 and extends upwardly and laterally. The handle 48 can be supported on either shaft 52 or 54. During normal operation, the handle is positioned on the shaft 52. If the machine is moved to a position adjacent a wall where the handle 48 would otherwise interfere, the handle can be mounted on the other shaft 54. The handle 48 can be releaseably joined to one or the other of the shafts 52 or 54 by a pin 56 which can be inserted through a bore in the handle 48 and into a complementary bore in the selected shaft.

Figure 2:
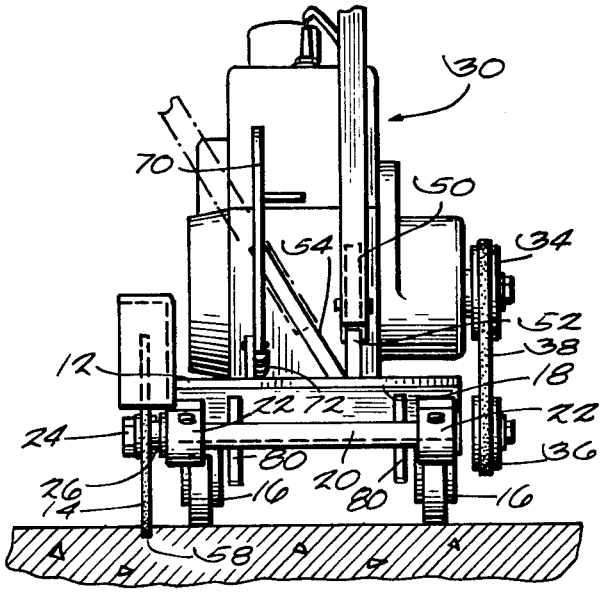
FIG. 2 is an end elevation view of the pavement grooving machine illustrated in FIG. 1.
Figure 4:
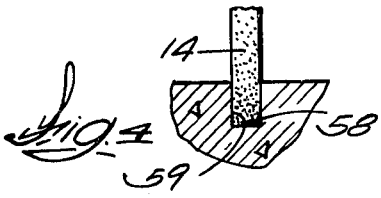
FIG. 4 is an enlarged view of a portion of the structure shown in FIG. 1.

In operation of the apparatus of the invention for use in forming grooves, the grooving blade 14 mounted on the mandrel 20 is pulled along the crack in the direction indicated by the arrow shown in FIG. 1, and the grooving blade 14 is rotatably driven so as to grind a groove 58 (FIG. 2 and 4) in the concrete. It has been found to be particularly useful to employ a ¼" thick, 8" diameter tuck point blade as a grooving blade 14. A suitable tuck point blade of that size is manufactured by Bullard Abrasive Products, Inc. Westboro, Massachusetts. The process using the apparatus described above produces a groove 58 having a depth of ½ to 1 inch and with generally parallel vertical sidewalls 59.

As previously stated, in many applications it is desired that the groove 58 have upwardly outwardly sloping sidewalls or that the upper edges of the sidewalls include beveled surfaces 66 to facilitate insertion of sealing material into the groove 58.

One of the features of the invention is that the machine 10 can be employed to also form beveled sides 66 on the groove. To form such beveled sides 66 on the groove, and using the apparatus illustrated in the drawings, the single blade 14 is removed from the mandrel 20 by removing the nut 24 and is replaced by a pair of similar blades 60 and 62 (FIG. 5), the blades 60 and 62 being placed in back-to-back relation and functioning as a grooving blade having a thickness twice that of the blade 14. While various conventional blades for use in cutting grooves in concrete and the like could be used, in one form of the invention the blades 60 and 62 can comprise tuck point blades of the type described above for use in forming a groove in the surface of the pavement.

Figure 5:
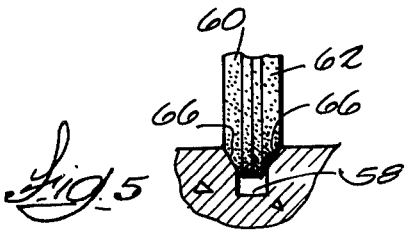
FIG. 5 is a view similar to FIG. 4 and illustrating the grooving blade assembly used in forming beveled side walls on the groove.

In operation of the machine to form the beveled sides 66, after the groove 58 is formed and the blade 14 is replaced with a pair of blades 60 and 62, the operator then moves the machine again along the length of the groove. During the initial contact of the blades 60 and 62 with the pavement, only the outside portions of the blades 60 and 62 will engage the pavement. The adjacent or facing portions of the blades will not engage the concrete and will not be worn. The outer edges or portions of the blades will be worn relatively quickly until they have a cross sectional configuration as shown in FIG. 5. As the machine is moved along the groove 58, the blades will tend to center themselves in the groove and grind the beveled surfaces on the opposite sides of the groove. The blades will also continue to be worn as shown in FIG. 5 since only the outer portions of the blades engage the pavement.

While in the illustrated construction the means for beveling the edges of the groove 58 includes a pair of blades 60 and 62, in other arrangements a single blade having a thickness greater than that of the groove 58 could be similarly employed.

Figure 3:
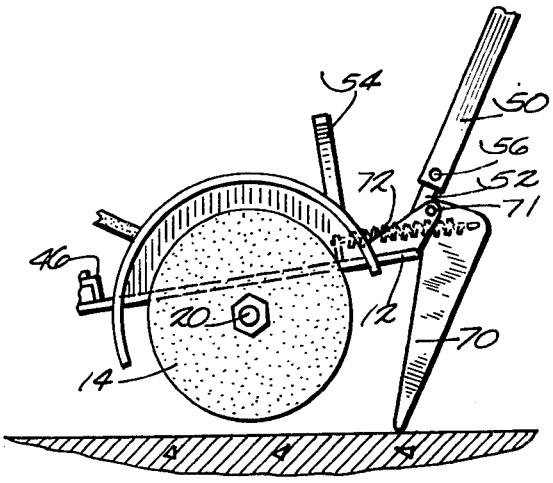
FIG. 3 is a partial view of the apparatus illustrated in FIG. 1 and with a support stand shown in a position supporting the grooving blade of the pavement grooving machine in an elevated relation.

Means are also provided for selectively supporting the blade or blades off of the surface of the pavement, and for supporting the machine 10 during starting of the engine 30. In the illustrated construction the means for supporting includes a lever 70 which is pivotally joined by a pivot pin 71 to the forward edge of the plate 12. A spring 72 connected at one end to the plate 12 and at an opposite end to the lever 70, releasably holds the lever 70 in an upwardly extending position as illustrated in FIG. 1. The lever 70 is movable to a second position wherein the lever 70 extends downwardly to engage the ground and to hold the blade 14 off of the ground as shown in FIG. 3. When the lever 70 is pivoted from the FIG. 1 to FIG. 3 position, the spring 72 moves overcenter and releasably retains the lever 70 in the downwardly extending position.

Means are also provided for protecting the pillowblocks 22 from potential damage as the blade 14 wears down, this protecting means including a pair of legs 80 extending downwardly from the plate 12 and including lower ends positioned below the lower surfaces of the pillowblocks 22.

Various features of the invention are set forth in the following claims.

I claim:

1. A machine for use in grinding a groove in pavement and for forming a beveled edge on the sidewalls of the groove, the machine including a frame having opposite ends, roller means for supporting said frame for movement along the pavement surface, said roller means including casters supporting one of said ends of said frame, a shaft rotatably supported by said frame and supported for rotation about a horizontal axis transverse to the direction of movement of said frame, said shaft having opposite ends, one of said ends of said shaft extending laterally of said frame, handle means for guiding said frame as said frame moves across the pavement surface, an engine supported on said end of said frame supported by said casters and drivingly connected to said shaft for rotatably driving said shaft, a pair of grooving blades mounted on said one end of said shaft such that said grooving blades are positioned in stacked face-to-face relation and laterally of said frame, said grooving blades being positioned on said shaft with the faces of said grooving blades defining vertical planes parallel to the direction of movement of said frame, and means for removably securing said pair of grooving blades on said shaft.

2. A machine as set forth in claim 1 wherein said frame comprises a flat metal plate having a planar lower generally horizontal surface and a planar upper horizontal surface.

3. A machine as set forth in claim 1 wherein said engine includes a drive shaft, and further including means for drivingly connecting said engine to said shaft rotatably supported by said frame, said means including a drive pulley on said engine drive shaft, a driven pulley on said shaft rotatably supported by said frame, and a belt drivingly connecting said drive pulley to said driven pulley.

4. A machine for use in grinding a groove in a pavement surface, the machine comprising a flat generally horizontal plate having a planar upper surface and a planar lower surface, and said plate having a forward portion, a rearward portion and spaced lateral sides, a pair of casters positioned beneath said rearward portion of said plate and for supporting the rearward portion of said plate for movement over said surface, a driven shaft being supported beneath a forward portion of said plate and said driven shaft being supported for rotation about a horizontal axis perpendicular to said spaced lateral sides of said plate, one end of said shaft projecting from one lateral side of said plate and the other end of said shaft projecting from an opposite lateral side of said plate, bearings mounted on said lower surface of said forward portion of said plate and rotatably supporting said driven shaft, an engine mounted on said upper surface of said rearward portion of said plate and generally above said casters, said engine including a rotatably driven output shaft, means for drivingly connecting said output shaft to said one end of said driven shaft, and a grooving blade mounted on the other end of said shaft for rotation with said driven shaft, said grooving blade being supported laterally of said plate.

5. A machine as set forth in claim 4 and further including a guiding handle assembly for guiding said frame for movement over said pavement surface, said guiding handle assembly including, a first inclined support shaft having a lower end joined to said forward portion of said plate and extending upwardly and forwardly, a secondary inclined support shaft having a lower end joined to said forward portion of said plate and extending upwardly and laterally, and a handle extension having an upper end and a lower end, said handle extension lower end including a socket for alternatively housing one of said inclined support shafts.

6. A machine as set forth in claim 4 and wherein said engine includes a flange adapted to be secured to said upper surface, bolts for securing said flange to said upper surface, and means for limiting the tightening of said bolts, said limiting means including brackets including a horizontal portion adapted to be clamped between said bolt and said flange and a second portion engageable with said plate.

7. A machine as set forth in claim 4 and further including means for selectively supporting said forward portion of said plate and said grooving blade off of the surface, said means for selectively supporting including, a lever having opposite ends, means for pivotally joining one of said ends to a forward portion of said plate and for selective pivotal movement between a first position wherein said lever does not engage the surface and a second position wherein an opposite end of said lever engages the surface and said lever supports the plate in an elevated position, and means for releasably holding said lever in said first position when said lever is in said first position and for supporting said lever in said second position when said lever is in said second position.

8. A method for grinding out a crack in pavement in preparation for filling the crack, the method comprising the steps of grinding a narrow groove in said pavement following said crack, said groove having generally planar vertical sidewalls, said step of grinding including mounting a single grooving blade having a uniform thickness on an end of a horizontal rotatably driven shaft and causing the grooving blade to engage the pavement surface and to move along the crack, replacing said single grooving blade with a second grooving blade means having a uniform thickness greater than the uniform thickness of said single grooving blade, causing the second grooving blade means to move along said groove such that the line of movement of the second grooving blade means is in the plane of the second grooving blade means and with opposite sides of the second grooving blade means engaging opposite edges of the groove so that the second grooving blade means becomes beveled and the sidewalls of the groove become outwardly sloping.

9. A method as set forth in claim 8 wherein said replacing step further includes the step of replacing said single grooving blade with a pair of grooving blades identical to said single grooving blade, said pair of grooving blades being positioned in stacked face-to-face relation.

* * * * *